US006915744B2

(12) United States Patent
Tirmizi

(10) Patent No.: US 6,915,744 B2
(45) Date of Patent: Jul. 12, 2005

(54) PYROTECHNIC INITIATOR WITH ON-BOARD CONTROL CIRCUITRY

(75) Inventor: Abrar Tirmizi, Simi Valley, CA (US)

(73) Assignee: Special Devices, Inc., Moorpark, CA (US)

( * ) Notice: Subject to any disclaimer, the term of this patent is extended or adjusted under 35 U.S.C. 154(b) by 242 days.

(21) Appl. No.: 09/899,398

(22) Filed: Jul. 5, 2001

(65) Prior Publication Data

US 2003/0005843 A1 Jan. 9, 2003

(51) Int. Cl.[7] ..... C06C 9/00; F42C 19/08
(52) U.S. Cl. ..... 102/202.9; 102/202.12
(58) Field of Search ..... 102/202.5, 202.9, 102/202.14, 530

(56) References Cited

U.S. PATENT DOCUMENTS

| | | | | | |
|---|---|---|---|---|---|
| 4,860,653 | A | | 8/1989 | Abouav | 102/200 |
| 5,200,574 | A | * | 4/1993 | Cunningham et al. | 102/530 |
| 5,204,491 | A | * | 4/1993 | Aureal et al. | 102/202.14 |
| 5,230,287 | A | * | 7/1993 | Arrell et al. | 102/202.5 |
| 5,889,228 | A | * | 3/1999 | Ewick et al. | 102/275.5 |
| 5,955,699 | A | * | 9/1999 | Perotto et al. | 102/530 |
| 6,070,531 | A | * | 6/2000 | Hansen et al. | 102/202.5 |
| 6,079,332 | A | * | 6/2000 | Marshall et al. | 102/202.5 |
| 6,164,208 | A | * | 12/2000 | Hsu et al. | 102/202.5 |
| 6,227,115 | B1 | * | 5/2001 | Gruber et al. | 102/202.9 |
| 6,341,562 | B1 | * | 1/2002 | Brisighella | 102/202.14 |
| 6,446,557 | B1 | * | 9/2002 | Lubbers | 102/202.9 |

FOREIGN PATENT DOCUMENTS

| | | | |
|---|---|---|---|
| GB | 2315118 | 1/1998 | F42B/3/188 |
| WO | WO 0040917 | 7/2000 | F42B/3/103 |

OTHER PUBLICATIONS

DiVecenzo, Fred "The chip's the star!", Sponsored Tutorial, accessed Mar. 8, 2005, available @ http://web.archive.org/web/20040102024728/http://www.neon.co.uk/campus/articles/motorola/motorola4.htm.*

TRW Automotive Holdings Corp. "TRW Automotive Reveals New Silicon Inititator Technology" Sep. 12, 2004, accessed Mar. 8, 2005, available @ http://biz.yahoo.com/prnews/041209/deth024_1.html.*

* cited by examiner

*Primary Examiner*—Michael J. Carone
*Assistant Examiner*—Daniel Lawson Greene, Jr.
(74) *Attorney, Agent, or Firm*—Law Offices of Thomas J. Brindisi

(57) ABSTRACT

A pyrotechnic initiator with enclosed on-board control circuitry, and a mating connector therefor.

16 Claims, 2 Drawing Sheets

PYROTECHNIC INITIATOR WITH ON-BOARD CONTROL CIRCUITRY

BACKGROUND OF THE INVENTION

The field of this invention generally relates to pyrotechnic initiators, and more particularly to an integral pyrotechnic initiator with control circuitry enclosed in a molded connector body.

Pyrotechnic initiators have many uses in industrial and consumer applications. One important use is the inflation of airbags in motor vehicles. A pyrotechnic initiator is placed in an airbag module. When ignited, the pyrotechnic initiator releases gas and heat that activates a gas generator (inflator), ruptures a sealed gas unit, or performs some other work that inflates the airbag. The pyrotechnic initiator is typically tightly secured to the inflator by one of a number of well-known attachment strategies. The pyrotechnic initiator is also electrically attached to control circuitry by a connector. As the number of initiators per automobile, enhanced control features, and low-energy firing features have all increased, initiators often referred to as "smart initiators" or "smart low energy initiators" ("SLEI") have been developed.

These smart initiators require control circuitry, such as a printed circuit board assembly (PCB), with active and passive electronic components. Such electronics require additional space inside the initiator, tending to increase the overall size of the initiator. Conventionally, the electronics have been incorporated between the ignition element and the gas seal area, with a PCB soldered to the output pins and the ignition element, encapsulated, and injection molded with nylon.

There are two main disadvantages to the existing design. First, the final assembly is larger than acceptable (especially for the driver's side) and requires re-qualification of the inflators. Also any future growth of the electronics may require re-qualification of the inflator. The second disadvantage is that the electronics are placed inside the gas seal area and exposed to high stresses during installation, operation, and deployment. These conditions compromise long term reliability.

SUMMARY OF THE INVENTION

The present invention is directed to a pyrotechnic initiator having a molded body that encloses on-board control circuitry provided in the mating connector area, where the output pins are conventionally placed. This causes only minimal changes to the existing inflator design and configuration that do not require re-qualification. In a separate aspect of the invention, the on-board electronics may be pre-encapsulated or molded as part of the final assembly of the initiator. In another separate aspect of the invention, retention features of the header assembly may be transferred to the output can.

DETAILED DESCRIPTION OF A PREFERRED EMBODIMENT

Figure 1:
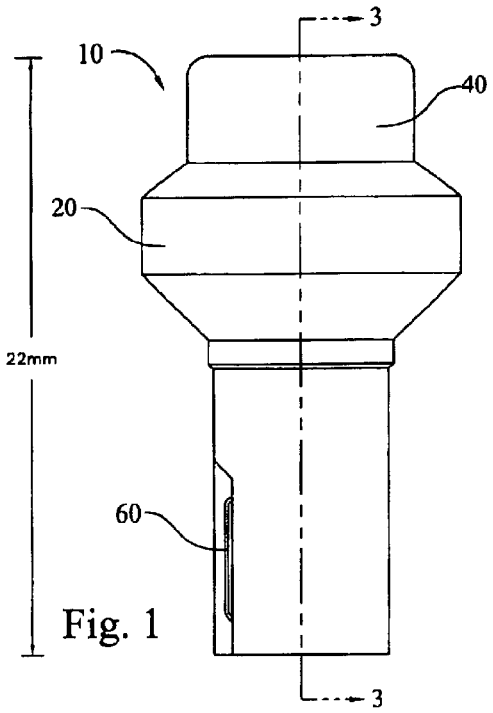
FIG. 1 is a side view of a pyrotechnic initiator of the present invention.
Figure 2:
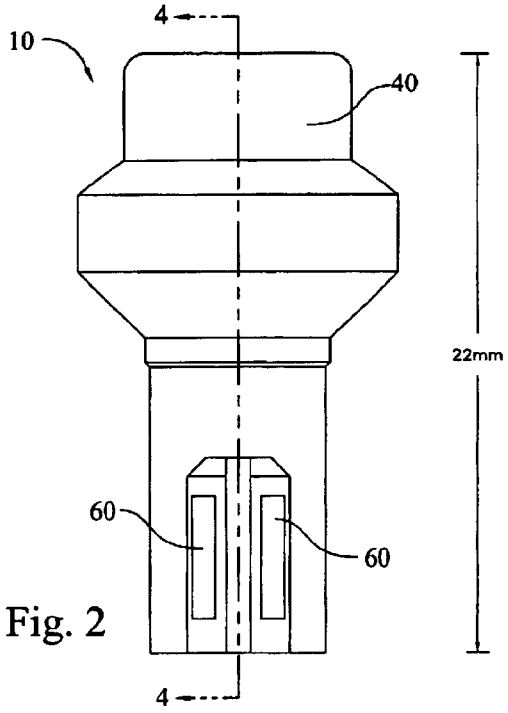
FIG. 2 is a front view of the initiator of FIG. 1.
Figure 3:
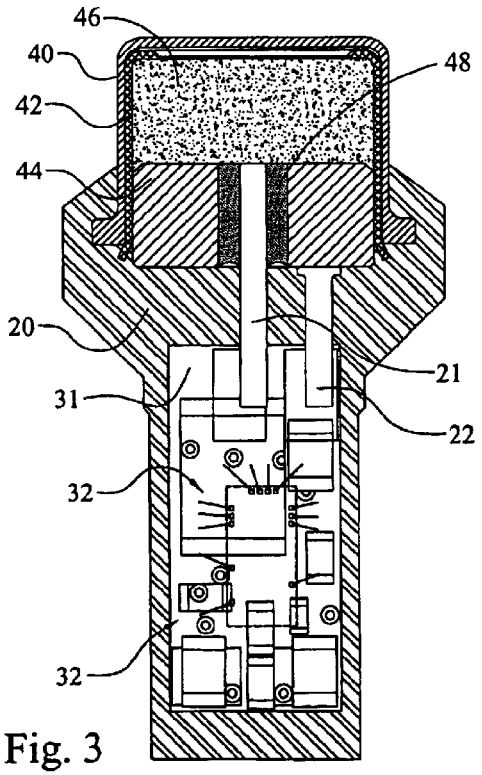
FIG. 3 is a sectional view taken through lines 3—3 of FIG. 1.
Figure 4:
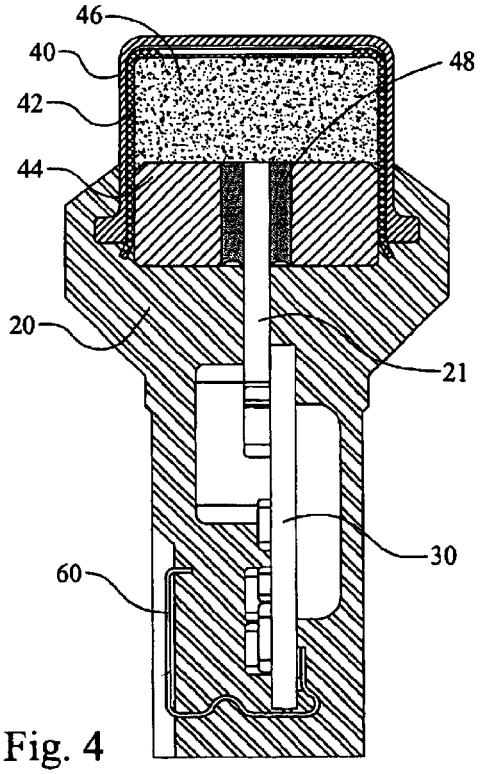
FIG. 4 is a sectional view taken through lines 4—4 of FIG. 2.
Figure 5:
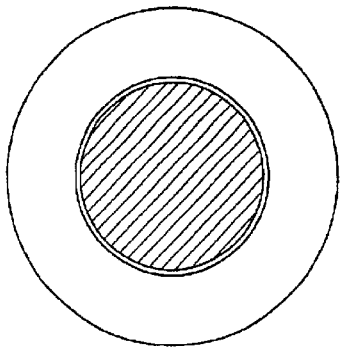
FIG. 5 is a top view of the initiator of FIG. 1.
Figure 6:
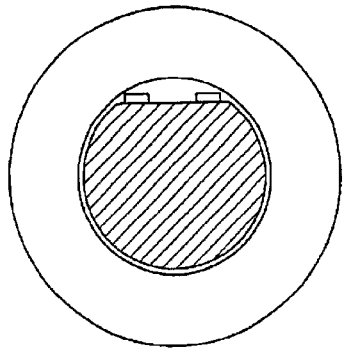
FIG. 6 is a bottom view of the initiator of FIG. 1.

As can be seen from FIGS. 1–9, in a preferred embodiment of the present invention, an initiator assembly 10 has a mating connector 80 and interconnections that are reconfigured in order to create space for an on-board PCB 30. Referring to FIGS. 3 and 4, it can be seen that initiator assembly 10 includes a generally conventional ignition element comprising a header eyelet 44, ground electrode pin 22, glass insulator 48, and isolated electrode pin 21, and a pyrotechnic charge 46 enclosed in output can 42.

Figure 8:
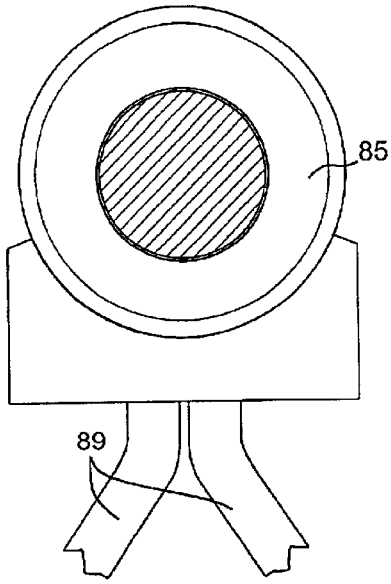
FIG. 8 is a top view taken through lines 8—8 of the mating connector of FIG. 7.
Figure 7:
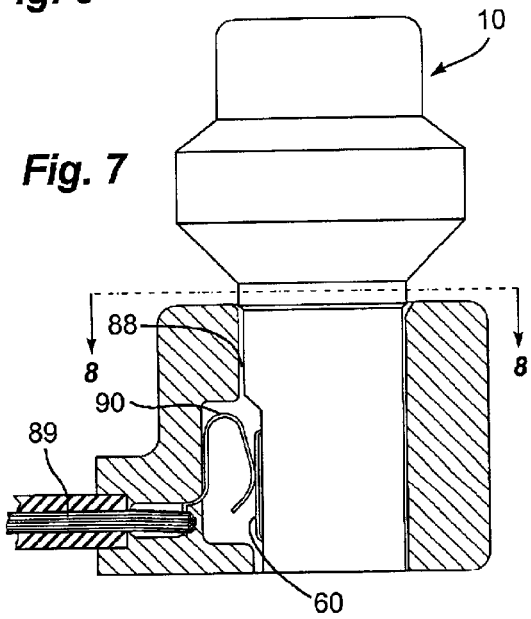
FIG. 7 is a sectional view of a mating connector with the connector end of the initiator of FIG. 1 inserted into it.
Figure 9:
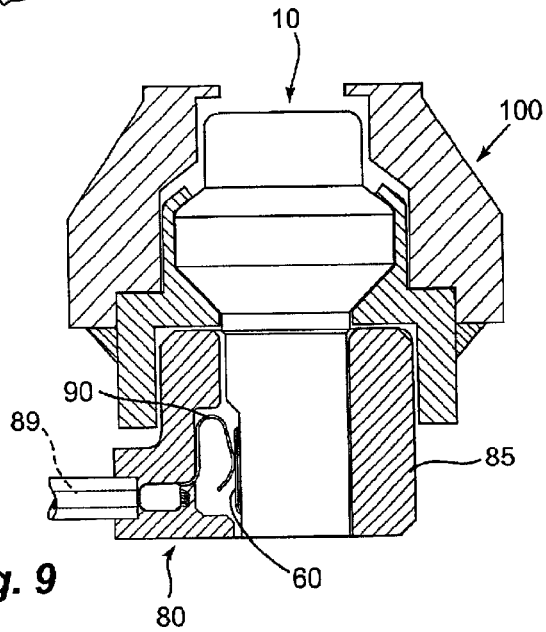
FIG. 9 is a sectional view similar to that of FIG. 7, but also showing the inflator into which the pyrotechnic charge-loaded end of the initiator of FIG. 1 is inserted.

PCB 30, however, which includes a board 31 and electronic components 32, is enclosed by initiator molded body 20, and provided as an integral part of the initiator that can be supplied as one piece to inflator manufacturers. PCB 30 is placed outside the gas seal area, away from crimping stresses incurred during installation of the inflator 100 (see FIG. 9), and away from the high compressive loads of firing. Because PCB 30 is kept in a less exposed, less stressed part of the initiator, it has an increased chance of survival and communication after deployment of the airbag. Pins 21 and 22 are connected to initiator electrical interface 60, which is configured to slidingly mate with the mating connector (FIGS. 7–9). It should also be noted that, as shown in the depicted embodiment, output can 42 and insulator cup 40 can be suitably flared at their bottoms to enhance their retention in initiator assembly 10.

Turning to FIGS. 7–9, mating connector 80 includes a conventional bus wire 89, but has an enlarged opening 88 defined by connector molded body 85, and a bus wire electrical interface 90. Bus wire electrical interface 90 is preferably configured to elastically deform enough to permit the connector end of initiator assembly 10 to be slidingly received, with initiator electrical interface 60 and bus wire electrical interface 90 held snugly together in secure electrical contact.

With a standardized interface between electronics and the inflator, several different types of PCB assemblies may be incorporated with an ignition element. The PCB may be produced by an outside vendor, encapsulated, and supplied to an initiator manufacturer who can then appropriately attach it to pins 21 and 22 and mold it for final assembly, such as by insert injection molding with suitable thermoplastic or thermoset material.

As a result of placing the control circuitry within the initiator in accordance with the present invention, the initiator and mating connector can have a beneficially compact overall size, and can, for example, be made with an overall axial length of under 21 millimeters.

A preferred pyrotechnic initiator having on-board electronics, and a mating connector therefor, and many of their attendant advantages, have thus been disclosed. It will be apparent, however, that various changes may be made in the form, construction and arrangement of the parts or in the steps of the process without departing from the spirit and scope of the invention, the form and process hereinbefore described being merely a preferred or exemplary embodiment thereof. Therefore, the invention is not to be restricted or limited except in accordance with the following claims and their legal equivalents.

What is claimed is:

1. An automotive pyrotechnic initiator assembly with on-board circuitry, comprising:

a) a pyrotechnic ignition element including two electrode pins;

b) control circuitry attached to said electrode pins;

c) an initiator body enclosing said electrode pins and said control circuitry; and d) an initiator electrical interface attached to said control circuitry, said interface including an exposed portion not enclosed within said initiator body, wherein the only exposed electrical contacts are directly lateral to at least part of said control circuitry.

2. The assembly of claim 1, wherein said initiator body is molded.

3. The assembly of claim 1, wherein said automotive pyrotechnic initiator assembly includes a gas seal area, and said control circuitry is remote from said gas seal area.

4. The assembly of claim 1, wherein said pyrotechnic ignition element includes an output can having a flared bottom that is enclosed within said initiator body.

5. The assembly of claim 1, wherein said pyrotechnic ignition element includes an insulator cup having a flared bottom that is enclosed within said initiator body.

6. The assembly of claim 4, wherein said pyrotechnic ignition element includes an insulator cup having a flared bottom that is enclosed within said initiator body.

7. The assembly of claim 2, wherein said pyrotechnic ignition element includes an output can having a flared bottom that is enclosed within said initiator body.

8. The assembly of claim 2, wherein said pyrotechnic ignition element includes an insulator cup having a flared bottom that is enclosed within said initiator body.

9. The assembly of claim 1, wherein said control circuitry is pre-encapsulated.

10. The assembly of claim 1, wherein said exposed portion of said initiator electrical interface comprises two exposed electrical contacts that are directly lateral to at least part of said control circuitry.

11. An on-board circuitry automotive pyrotechnic initiator and mating connector assembly, comprising:

a) a pyrotechnic ignition element including two electrode pins;

b) control circuitry attached to said electrode pins;

c) an initiator body enclosing said electrode pins and said control circuitry;

d) an initiator electrical interface attached to said control circuitry, said interface including an exposed portion not enclosed within said initiator body, wherein the only exposed electrical contacts are directly lateral to at least part of said control circuitry.

e) a mating connector body including an enlarged initiator opening defined therein, said enlarged initiator opening formed to receive a portion of said initiator body enclosing said control circuitry; and f) a bus wire connected to said mating connector body and including a bus wire electrical interface disposed within said enlarged initiator opening, said bus wire electrical interface formed to mate with said initiator electrical interface.

12. The assembly of claim 11, wherein said exposed portion of said initiator electrical interface comprises two exposed electrical contacts that are directly lateral to at least part of said control circuitry.

13. The assembly of claim 11, wherein said assembly includes a gas seal area, and said control circuitry is remote from said gas seal area.

14. An on-board circuitry automotive pyrotechnic initiator and mating connector assembly, comprising:

a) a pyrotechnic ignition element including two electrode pins;

b) control circuitry attached to said electrode pins;

c) an initiator body enclosing said electrode pins and said control circuitry;

d) an initiator electrical interface attached to said control circuitry, said interface including an exposed portion not enclosed within said initiator body, wherein the only exposed electrical contacts are directly lateral to at least part of said control circuitry.

e) a mating connector body including an enlarged initiator opening defined therein, said enlarged initiator opening formed to receive a portion of said initiator body enclosing said control circuitry; and f) a bus wire connected to said mating connector body and including a bus wire electrical interface disposed within said enlarged initiator opening, said bus wire electrical interface formed to mate with said initiator electrical interface, wherein said enlarged initiator opening includes an engagement feature formed to snugly hold said initiator body in place when said initiator body is received within said enlarged initiator opening.

15. The assembly of claim 14, wherein said exposed portion of said initiator electrical interface comprises two exposed electrical contacts that are directly lateral to at least part of said control circuitry.

16. The assembly of claim 14, wherein said assembly includes a gas seal area, and said control circuitry is remote from said gas seal area.

* * * * *